US007503187B2

(12) United States Patent
Richardson

(10) Patent No.: US 7,503,187 B2
(45) **Date of Patent: *Mar. 17, 2009**

(54) CONNECTING DEVICES, INTERCHANGEABLE MEMBERS, AND METHODS FOR CONNECTING THE SAME

(75) Inventor: Dana Richardson, Salt Lake City, UT (US)

(73) Assignee: Spectrum Gems, Inc., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/925,332

(22) Filed: Oct. 26, 2007

(65) Prior Publication Data

US 2008/0040904 A1 Feb. 21, 2008

Related U.S. Application Data

(63) Continuation of application No. 11/190,792, filed on Jul. 27, 2005, now Pat. No. 7,353,665.

(60) Provisional application No. 60/591,764, filed on Jul. 27, 2004.

(51) Int. Cl.

| | |
|---|---|
| ***A44C 5/00*** | (2006.01) |
| ***A44C 5/10*** | (2006.01) |
| ***A44B 11/25*** | (2006.01) |

(52) U.S. Cl. ..... 63/38; 63/3; 63/3.1; 24/653; 24/655; 24/667; 24/702

(58) Field of Classification Search ..... 24/522–524, 24/527, 629, 633, 640, 642, 652, 654, 656, 24/662, 664, 666, 700–702; 63/1.11, 1.16–1.18, 63/3, 3.1, 26, 29.1, 31, 33, 40

See application file for complete search history.

(56) References Cited

U.S. PATENT DOCUMENTS

| | | | |
|---|---|---|---|
| 236,441 | A | 1/1881 | Laflin |
| 244,475 | A | 7/1881 | Orcutt |
| 653,397 | A | 7/1900 | Pettijohn |

(Continued)

OTHER PUBLICATIONS

Clasps Plus, Inc., 2003 Clasp Encyclopedia, vol. 5, pp. 62-63, New York, New York, Printed in Korea.

*Primary Examiner*—Robert J Sandy
*Assistant Examiner*—Ruth C Rodriguez
(74) *Attorney, Agent, or Firm*—TraskBritt

(57) ABSTRACT

A clasp for releasably fastening two objects is disclosed. The clasp includes a male member and a female member. The female member includes a displaceable member that is movable between a first position and a second position. In the first position, the displaceable member precludes insertion of the male member into or removal of the male member from the female member. In the second position, the male member may be inserted into or removed from the female member. Alternatively, the clasp may include two objects that each contain both male and female parts.

20 Claims, 14 Drawing Sheets

U.S. PATENT DOCUMENTS

| | | | | |
|---|---|---|---|---|
| 1,141,992 | A | | 6/1915 | Toelcke |
| 1,265,778 | A | | 5/1918 | Hartline |
| 1,368,665 | A | | 2/1921 | Strauss |
| 1,380,244 | A | | 5/1921 | Otis |
| 1,419,043 | A | | 6/1922 | Gray |
| 1,464,452 | A | | 8/1923 | Starck |
| 1,650,506 | A | | 11/1927 | Gagnon |
| 1,692,649 | A | | 11/1928 | Goodridge et al. |
| 1,769,245 | A | | 7/1930 | Tregoning |
| 2,725,610 | A | | 12/1955 | Smith |
| 2,853,759 | A | | 9/1958 | Elsner |
| 3,332,163 | A | | 7/1967 | Stewart et al. |
| 3,513,510 | A | | 5/1970 | Copes |
| 4,001,923 | A | | 1/1977 | Frankel et al. |
| D247,101 | S | | 1/1978 | Durante |
| 4,245,377 | A | | 1/1981 | Soltes |
| 4,277,866 | A | | 7/1981 | Song |
| 4,310,953 | A | | 1/1982 | Nanasi |
| 4,364,155 | A | | 12/1982 | Synowicki |
| 4,369,551 | A | | 1/1983 | Heredia |
| 4,393,552 | A | | 7/1983 | Frankel |
| 4,426,854 | A | | 1/1984 | Geldwerth et al. |
| 4,520,537 | A | | 6/1985 | Valikov |
| 4,566,159 | A | | 1/1986 | Leroux |
| 4,713,865 | A | | 12/1987 | Geldwerth |
| 4,813,108 | A | | 3/1989 | Geldwerth |
| 4,847,957 | A | * | 7/1989 | Ranta ..... 24/598.2 |
| 4,881,305 | A | | 11/1989 | Rivera |
| 4,958,420 | A | | 9/1990 | Bunz |
| 5,412,850 | A | | 5/1995 | Miranda |
| 5,412,933 | A | | 5/1995 | Mallett et al. |
| D377,462 | S | | 1/1997 | Kassardjian |
| 5,628,095 | A | | 5/1997 | Appel et al. |
| 5,653,009 | A | | 8/1997 | Kassardjian |
| 6,041,479 | A | | 3/2000 | Colpo |
| 6,357,261 | B1 | | 3/2002 | Cheng |
| 6,415,483 | B1 | | 7/2002 | Dang |
| 6,484,376 | B1 | | 11/2002 | Khatchadourian et al. |
| 6,508,080 | B1 | | 1/2003 | Ninomiya |
| 6,640,398 | B2 | | 11/2003 | Hoffman |
| 6,729,159 | B2 | | 5/2004 | Rose |

* cited by examiner

CONNECTING DEVICES, INTERCHANGEABLE MEMBERS, AND METHODS FOR CONNECTING THE SAME

CROSS-REFERENCE TO RELATED APPLICATIONS

This application is a continuation of U.S. patent application Ser. No. 11/190,792, filed Jul. 27, 2005, now U.S. Pat. No. 7,353,665 issued Apr. 8, 2008, which application claimed priority from Provisional Patent Application Ser. No. 60/591,764, filed Jul. 27, 2004, under the provisions of 35 U.S.C. § 119(e). The disclosure of each of the previously referenced U.S. patent applications referenced is hereby incorporated by reference in its entirety.

TECHNICAL FIELD

The present invention generally relates to clasps. More particularly, the invention relates to jewelry clasps, interchangeable decorative pieces for jewelry, such as bracelets, necklaces, earrings, pendants, etc., and methods of connecting the same.

BACKGROUND

Jewelry clasps must provide a secure connection to prevent accidental unfastening, which often results in loss of the jewelry. At the same time, clasps must be relatively easy to connect, since often they must be connected behind the neck of the person wearing the jewelry (in the case of a necklace) or with only one hand (in the case of a bracelet).

An early design for jewelry clasps consists of a small bead fastened to one end of the piece of jewelry. A seamed tubular member having a lateral opening on the seam and two smaller openings on the ends is fastened to the other end. To secure the two ends together, the ball is inserted into the lateral opening and pulled towards an end of the tubular member. The string or wire of the jewelry piece is forced through the seam until it extends through one of the smaller openings in an end of the tubular member.

The claw-type jewelry clasp is another commonly used coupling for jewelry pieces. In the claw-type clasp, a ring is placed on one end of the jewelry piece, and a J-shaped member is placed on the other end of the piece. Usually, a spring-loaded member acts against the J-shaped member to close the gap of the J-shaped member forming a closed second ring. A force is exerted on the spring-loaded member to open the second ring. The first ring is then slid onto the J-shaped member and the spring-loaded member is released to close the gap at the end of the J-shaped member, thereby preventing removal of the ring from the J-shaped member or second ring.

Leaf spring type connectors are also commonly used in jewelry clasps. Typically, a male member is attached to one end of a jewelry piece that is releasably connectable to a female member attached to the other end of the jewelry piece. A leaf spring component, usually comprising a deflectable metal member supported at only one end thereof, is provided on the male member. The leaf spring component is deflected or compressed upon initial insertion into the female member. After the male member is inserted a predetermined distance into the female member, the resilience of the leaf spring component causes the component to snap back into mating abutment with a corresponding feature formed in the female member, thereby preventing removal of the male member therefrom. To release the male member from the female member, a user must exert a force on the leaf spring to force the component out of mating abutment with the corresponding feature of the female member while simultaneously pulling the two members apart.

These clasps are often cumbersome and may unintentionally unfasten. While clasps may include safety or locking features, they are often difficult to use. Further, it is often awkward to connect a clasp for a necklace behind one's own neck or to connect a bracelet using only one hand. Thus, additional improvements are desired. Further, it may be appreciated that there is a need in the art for a clasp that may be incorporated into individual decorative jewelry pieces that may be removably fastened to one another, thereby providing an interchangeable jewelry piece that may be changed at any time to match clothing or to create a unique, one-of-a-kind design.

SUMMARY OF THE INVENTION

In accordance with one embodiment, a clasp is disclosed that includes at least one male member and a cooperating female member. The at least one male member includes a first section and a larger second section. The female member includes a main body having a hollow portion, an outer wall, and an exterior surface. The female member further includes at least one aperture formed through the outer wall and a displaceable aperture sealing member adjacent the exterior surface of the main body. The at least one aperture of the female member includes a first portion sized to preclude passage of the larger second section of the male member and to allow passage of the first section of the male member therethrough, and a second larger portion continuous with the first portion sized to allow passage of both the first section of the male member and the second larger section of the male member therethrough. The displaceable sealing member may be movable between a first position at least partially covering the second larger portion of the at least one aperture, and a second position exposing the second larger portion of the at least one aperture.

A piece of jewelry that includes a plurality of clasps is also disclosed. Each clasp of the plurality of clasps includes a first female member and a male member. The female member includes a main body having at least one hollow portion, an outer wall, and an exterior surface. The female member further includes at least one aperture formed through the outer wall, and a displaceable aperture sealing member adjacent the exterior surface of the main body. The at least one aperture includes a first portion and a second larger portion continuous with the first portion. The displaceable aperture sealing member may be movable between a first position, in which the sealing member at least partially covers the second larger portion of the at least one aperture, and a second position, in which the second larger portion of the at least one aperture may be exposed. The male member may include a rod extending from the exterior surface of the main body of the female member. The rod may be disposed on a side of the main body generally opposite the first portion of the at least one aperture. An enlarged member may be formed on an end of the rod distant to the main body. Alternatively, the enlarged member may be connected directly to the main body. The male member may be connected to a second female member.

A piece of jewelry that includes a first member and a second member is also disclosed. The first member may include a decorative jewelry piece, an elongated rod extending from the decorative jewelry piece, and a retaining member on the end of the rod opposite the decorative jewelry piece. Alternatively, the retaining member may be connected directly to the decorative jewelry piece. The second member may include a main body and a void inside at least a portion of the main body. The second member may further include a first aperture and a second aperture in the exterior surface of the second member that communicate with the void. The first aperture may be sized to allow passage of the rod therethrough and to preclude passage of the retaining member therethrough. The second aperture may be sized to allow passage of the retaining member therethrough. The second member may also include a slot in the exterior surface of the main body that communicates with the void, the first aperture, and the second aperture. The slot may be sized to allow passage of the rod therethrough and to preclude passage of the retaining member therethrough. The second member may also include a displaceable external aperture sealing member disposed on the exterior surface thereof. The sealing member may be displaceable between a first position and a second position. In the first position, the sealing member may be disposed adjacent the second aperture to preclude passage of the retaining member therethrough.

Also disclosed is a method of removably securing two members of a piece of jewelry using a clasp according to the invention. The female member and body with attached male member of the clasp of the present invention may be substantial in size which improves the ease with which a person may secure the clasp. For example, the female member may comprise a decorative element of a jewelry piece and the body may be, as a non-limiting example, a pearl with a male member therethrough. Thus, a user may easily grasp and maneuver the female member and pearl to secure the male member in the female member.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

Figure 1A:
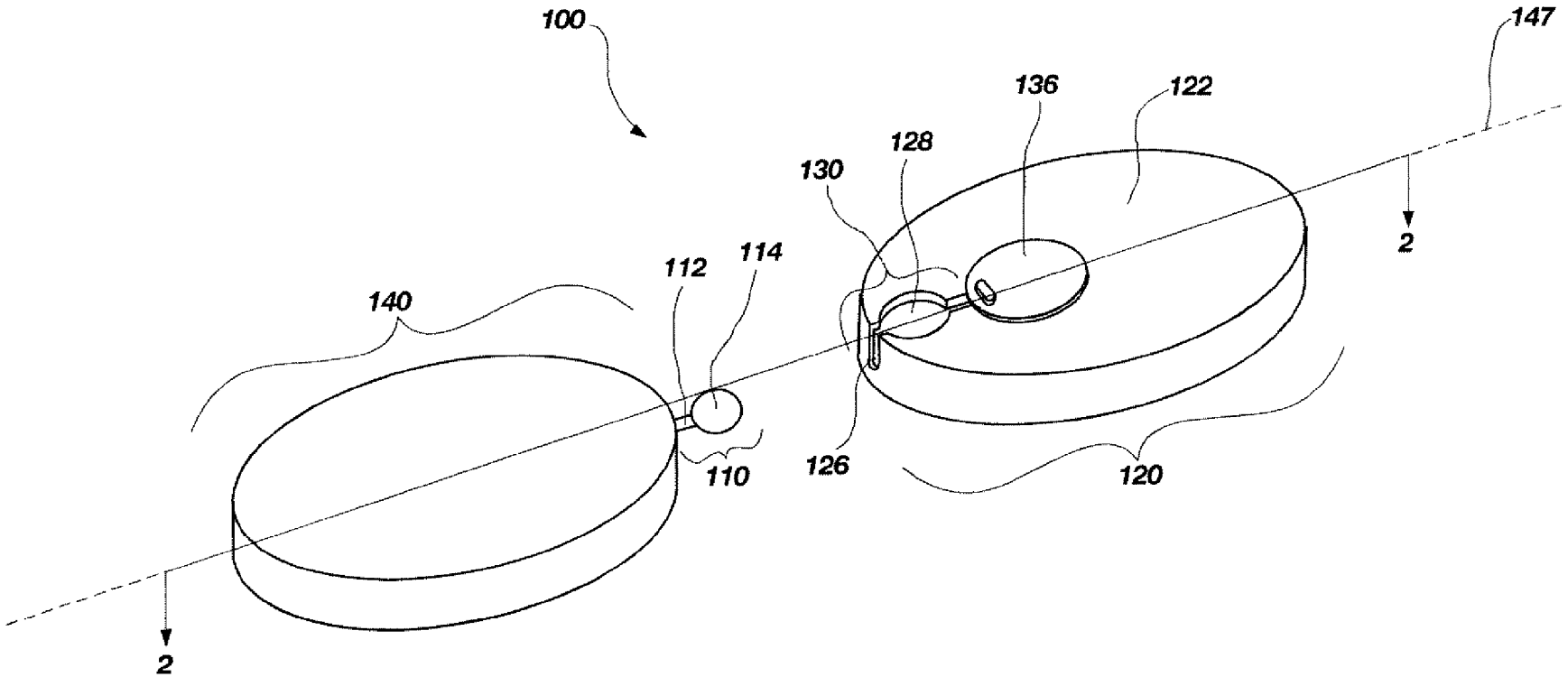
FIG. 1A is a perspective view of an exemplary embodiment of the invention.

The present invention generally relates to clasps that may be used to connect or secure a variety of objects including jewelry such as bracelets, necklaces, earrings, pendants, etc. More particularly, the invention relates to clasps, interchangeable jewelry pieces, and methods of connecting the same. The clasps disclosed herein may be incorporated into individual and personalized jewelry pieces, such as individual links in a bracelet or chain, earrings, pendants, etc., thereby allowing a user to interchange individual pieces quickly and easily. In addition, the features of the clasps of the present invention may be incorporated into individual, interchangeable decorative jewelry pieces of different colors or designs. This allows a user to select and purchase individual pieces, which then may be used to create unique, personalized and interchangeable jewelry pieces. The clasps of the present invention may also be used as a traditional jewelry clasp for securing the ends of a jewelry piece. Like reference numerals refer to like elements throughout the specification and figures.

A perspective view of an exemplary embodiment of the invention is shown in FIG. 1A. A clasp 100 is shown including a first body 140 and a second body 120. The first body 140 includes a male member 110 having an elongated rod 112 with an enlarged member 114 formed on an end of the elongated rod 112. The elongated rod 112 may be any desired length. Alternatively, the enlarged member 114 may be attached directly to the first body 140. The second body 120 (or female member) is provided having a main body 122, which is at least partially hollow, a first aperture 126, a second aperture 128, and a slot 130 extending continuously between the first aperture 126 and the second aperture 128. The slot 130 may be any desired length, though for aesthetics, it may be desirable for length of slot 130 to be minimal. A displaceable aperture sealing member 136 may be movably attached to the main body 122 and may be disposed adjacent the exterior surface thereof. The aperture sealing member 136 is shown located laterally adjacent the second aperture 128, which is exposed in FIG. 1A. Aperture sealing member 136 may be textured or raised such that it is easily gripped and moved. Alternatively, the aperture sealing member may be flat, domed or be a decorative aspect of the clasp.

The male member 110 may be attached to a first body 140 by, for example, soldering. Alternatively, the elongated rod 112 of the male member 110 may be of sufficient length to extend entirely through the first body 140, and may be attached to a chain or other jewelry piece at the end thereof opposite the enlarged member 114 on the opposite side of the first body 140. Alternatively, the male member 110 may be attached to the end of a chain such as a bracelet or necklace. The second body 120 may be attached directly to a piece of jewelry to be fastened or may include a male member (not shown) on the side of the main body 122 opposite the first aperture 126. Similarly, either the male member 110 (or a first body 140 attached to the male member 110) may be attached to the end of a piece of jewelry to be fastened, such as for example, a bracelet or necklace (not shown in FIG. 1A). The first body 140 may be a decorative element or may be purely functional.

Figure 1B:
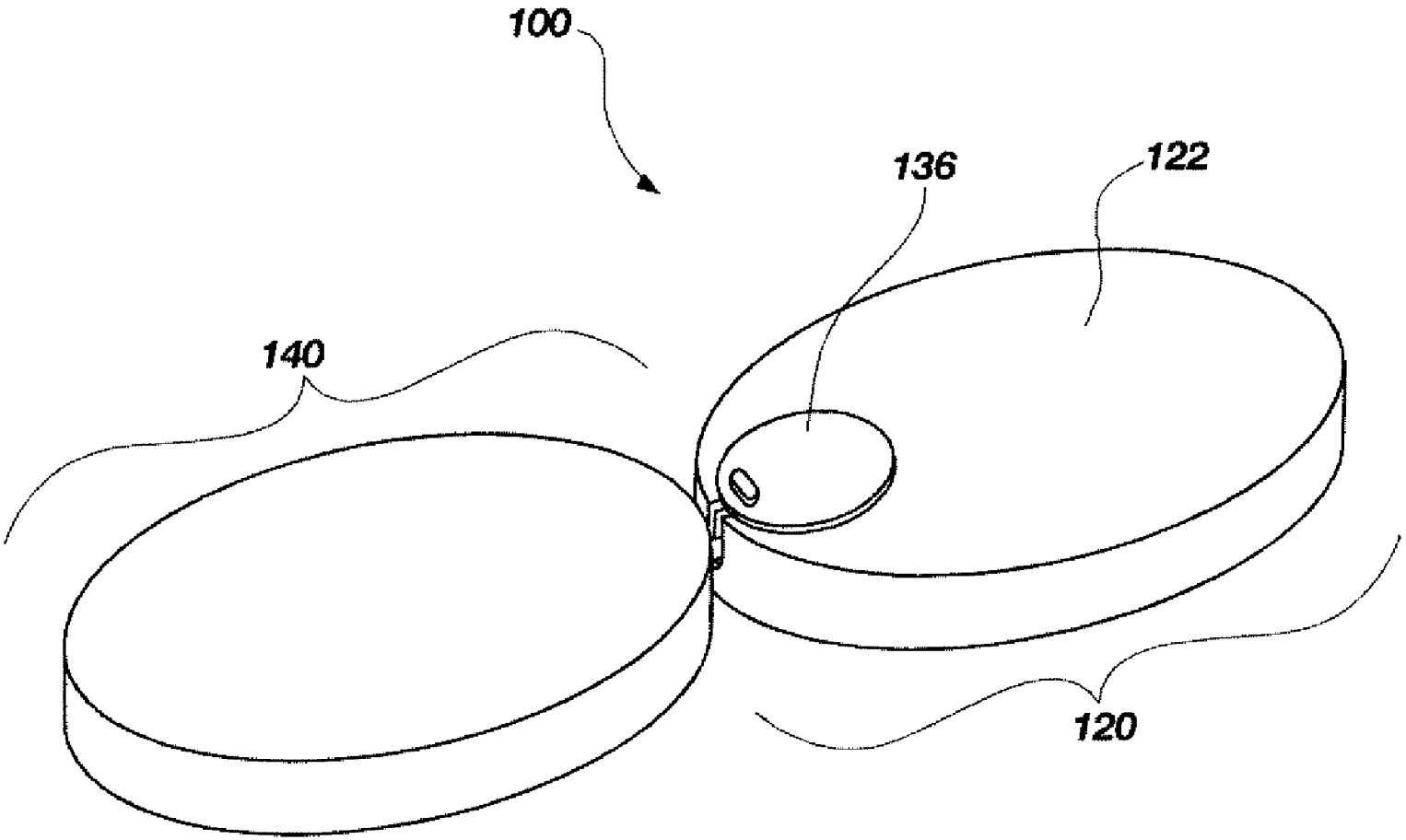
FIG. 1B is a perspective view of the exemplary embodiment of FIG. 1A in the assembled state.

The clasp 100 shown in FIG. 1A is shown in the assembled state in FIG. 1B. In the assembled state, the first body 140 is proximate the main body 122 of the second body 120. The aperture sealing member 136 may be disposed directly above and covering the second aperture (not visible in FIG. 1B).

As seen in FIG. 1A, the displaceable aperture sealing member 136 may be displaceable in a direction generally parallel to a reference line 147 that extends along the outer surface of the hollow main body 122 of the second body 120 between the first aperture 126 and the second aperture 128. Alternatively, the displaceable aperture sealing member 136 may be displaceable in any direction relative to the reference line 147.

Figure 2A:
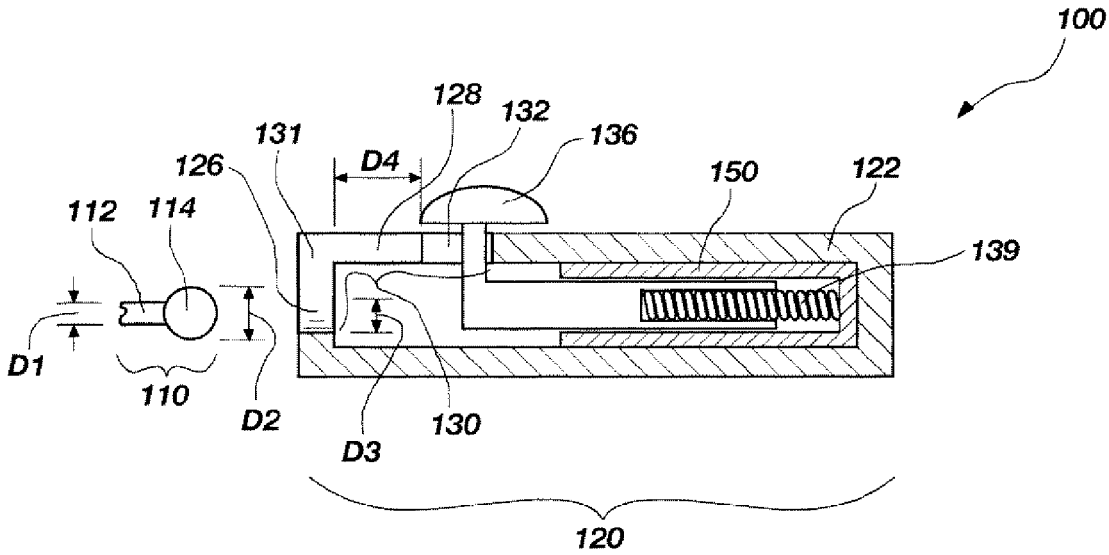
FIGS. 2A and 2B are sectional views taken along line 2-2 of the embodiment of FIG. 1A.
Figure 2B:
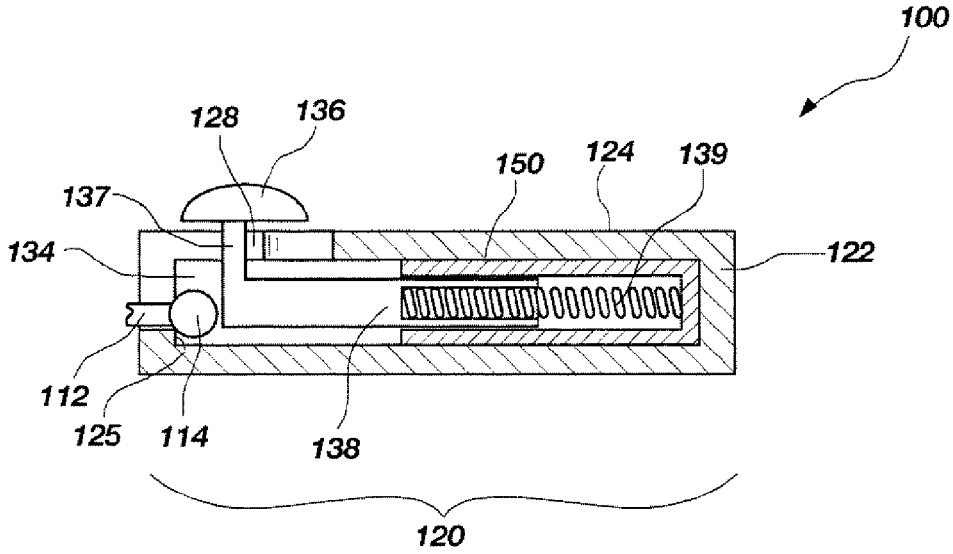

The function of the clasp 100 may be further understood with reference to FIGS. 2A and 2B, which are cross-sectional views of the clasp 100 taken along line 2-2 in FIG. 1A and FIG. 1B. FIGS. 2A and 2B show the clasp 100 in the disassembled and assembled configurations, respectively. The elongated rod 112 of the male member 110 may be formed as an elongated cylindrical member having a diameter $D_1$. The elongated rod 112 alternatively may be formed as an elongated polyhedron or any other desired shape. The enlarged member 114 of the male member 110 may be formed as a sphere having a diameter $D_2$, although any other enlarged shape such as an ovoid or a polyhedron may be used. The first aperture 126 of second body 120 may be formed having a circular shape having a diameter $D_3$ greater than $D_1$ but less than $D_2$ to allow the elongated rod 112 to pass therethrough, while precluding passage of the enlarged member 114 therethrough. Alternatively, the first aperture 126 may be formed having any size and shape allowing the elongated rod 112 to pass therethrough, while precluding passage of the enlarged member 114 therethrough. The second aperture 128 also may be formed having a circular shape having a diameter $D_4$ larger than both $D_1$ and $D_2$, thereby allowing passage of both the enlarged member 114 and the elongated rod 112 of the male member 110 therethrough. Alternatively, the second aperture 128 may be formed having any size and shape allowing both the elongated rod 112 and the enlarged member 114 to pass therethrough. The general relationship of the size of each of the four diameters may be described as follows: $D_1<D_3<D_2<D_4$.

The slot 130 should have a width greater than the diameter $D_1$ of the elongated rod 112 but smaller than the diameter $D_2$ of the enlarged member 114. The slot 130 may have a width that is smaller than $D_3$ (as shown in FIG. 1A); although the width of the slot 130 could be equal to, or slightly greater than $D_3$ provided the width is less than $D_2$. As seen in FIG. 2A, the slot 130 may include two sections, a first section 131 that extends between the first aperture 126 and the second aperture 128, and a second section 132 that extends a short distance from the second aperture 128 on the side thereof opposite to the first section 131. The first aperture 126, the second aperture 128, and the slot 130 are all connected and continuous, and therefore may be considered portions of a single opening. In addition, the first aperture 126 and the second aperture 128 may be formed through the main body 122 of the second body 120 at any location on the exterior surface thereof provided the slot 130 extends therebetween.

As seen in FIG. 2B, the displaceable aperture sealing member 136 may be coupled to the second body (female member) 120 by a vertical support member 137, a horizontal support member 138 having a tubular section, a tubular member 150, and a biasing member, shown as a spring 139. The tubular member 150 may be welded or otherwise attached to an interior surface of the main body 122 of the second body (female member) 120. The outer diameter of at least a section of the horizontal support member 138 may be smaller than the inner diameter of the tubular member 150 such that the section of the horizontal support member 138, including the tubular section, may slide within the tubular member 150. The biasing member, or spring 139 may be disposed within the tubular member 150 and may extend into the tubular section of the horizontal support member 138. The biasing member, or spring 139 may act against the horizontal support member 138, exerting a force therein which tends to move the horizontal support member 138 in the leftward direction in FIGS. 2A and 2B. The aperture sealing member 136 is shown in a first position in FIG. 2B, in which the spring 139 is extended and the aperture sealing member 136 is disposed adjacent the exterior surface 124 of the main body 122 directly above the second aperture 128. In this position, the enlarged member 114 is precluded from passing either into or out of the main body 122 through the second aperture 128. The aperture sealing member 136 is shown in a second position in FIG. 2A, in which the spring 139 is compressed and the aperture sealing member 136 is disposed laterally relative to the second aperture 128, thereby exposing the second aperture 128. In this configuration, the enlarged member 114 of the male member 110 may be inserted into or removed from the hollow main body 122 of the second body 120.

To fasten the male member 110 and the second body (female member) 120 together, a force may be exerted on the aperture sealing member 136, causing the spring 139 to compress and the aperture sealing member 136 to move out of the first position (FIG. 2B) and into the second position (FIG. 2A), thereby exposing the second aperture 128. The enlarged member 114 of the male member 110 then may be inserted through the second aperture 128 until the enlarged member 114 is disposed in a void 134 (FIG. 2B) of the second body (female member) 120 and the elongated rod 112 extends through the second aperture 128.

The male member 110 may be displaced relative to the second body (female member) 120 such that the rod 112 passes along or slides through the slot 130 of the second body (female member) 120 until the rod 112 extends through the first aperture 126, the enlarged member continuing to be disposed within the void 134 of the main body 122 of the second body 120 and retained by the interior surface 125 thereof.

The displaceable aperture sealing member 136 then may be released, allowing the biasing member or spring 139 to extend and causing the horizontal support member 138, the vertical support member 137, and the aperture sealing member 136 to return to the first position shown in FIG. 2B. In this configuration, the enlarged member 114 is precluded from passing through the second aperture 128 and may be retained and secured within the void 134 of the second body 120.

The internal components of the main body 122 are not limited to the tubular member shown in FIG. 2A and FIG. 2B. Instead, any biasing system or spring which permits the aperture sealing member 136 to move between a first and second position as described herein is sufficient. A biasing member may interact with the aperture sealing member 136 to bias the aperture sealing member 136 in the first position. As a non-limiting example, the biasing member may be a coil spring, a leaf spring or an elastomer material. The biasing member may be disposed adjacent the exterior surface 124 of the main body 122.

Figure 3A:
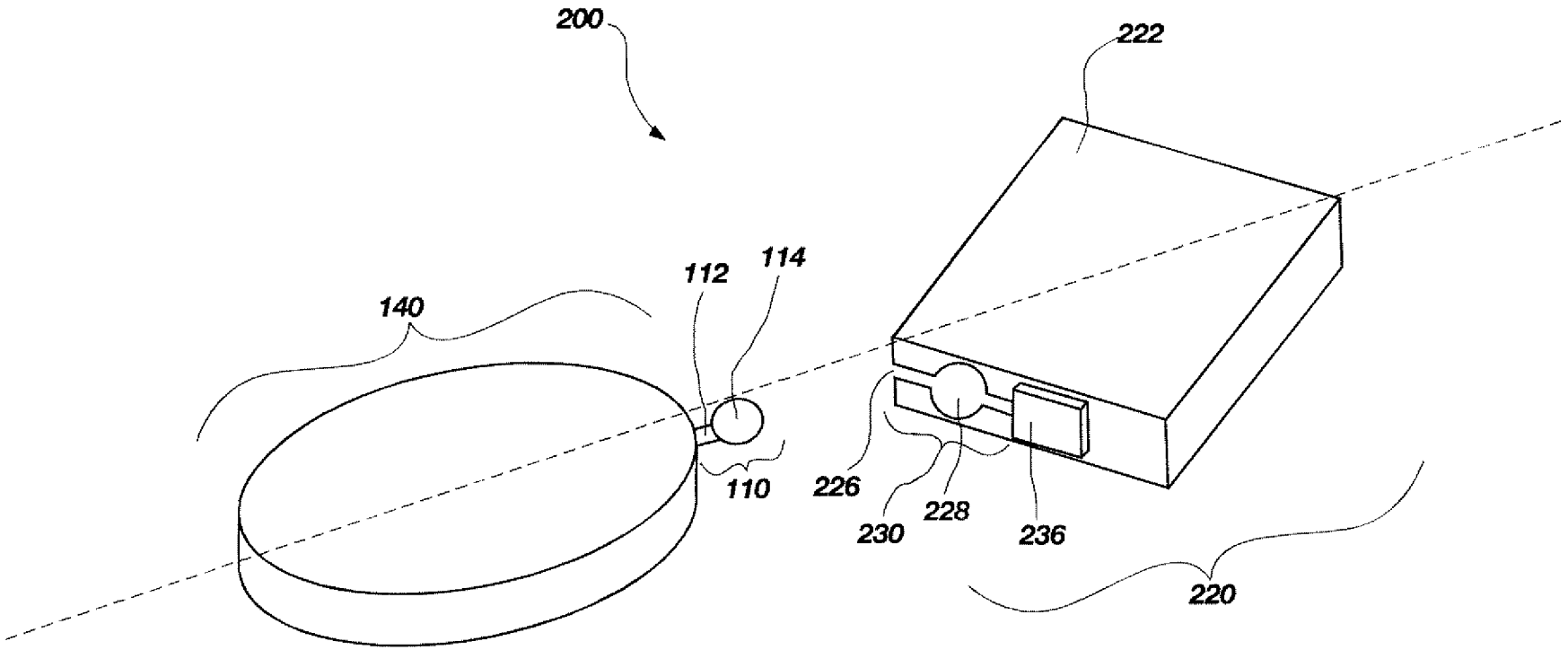
FIG. 3A is a perspective view of an exemplary embodiment of the invention.

In another exemplary embodiment of the invention shown in FIG. 3A, a clasp 200 may include a first body 140 including male member 110 having an elongated rod 112 with an enlarged member 114 formed on an end of the elongated rod 112. A female member 220 may be provided having an at least partially hollow main body 222, a first aperture 226, a second aperture 228, and a slot 230 extending continuously between the first aperture 226 and the second aperture 228. A displaceable aperture sealing member 236 may be movably attached to the main body 222 and may be disposed adjacent an exterior surface thereof. The clasp 200 is substantially similar to the clasp 100 of FIGS. 1A, 1B, 2A, and 2B, and may operate in a substantially similar fashion thereto. However, the main body 222 of the female member 220 has a square shape, the first aperture 226 may be disposed on a corner of the female member 220 at the junction of two side surfaces thereof, and the displaceable aperture sealing member 236 may be disposed on a side surface of the female member 220. The displaceable aperture sealing member 236 is shown located laterally adjacent the second aperture 228, which is exposed in FIG. 3A. In addition, the displaceable aperture sealing member 236 may be or may include a decorative piece such as a gem or stone.

Figure 3B:
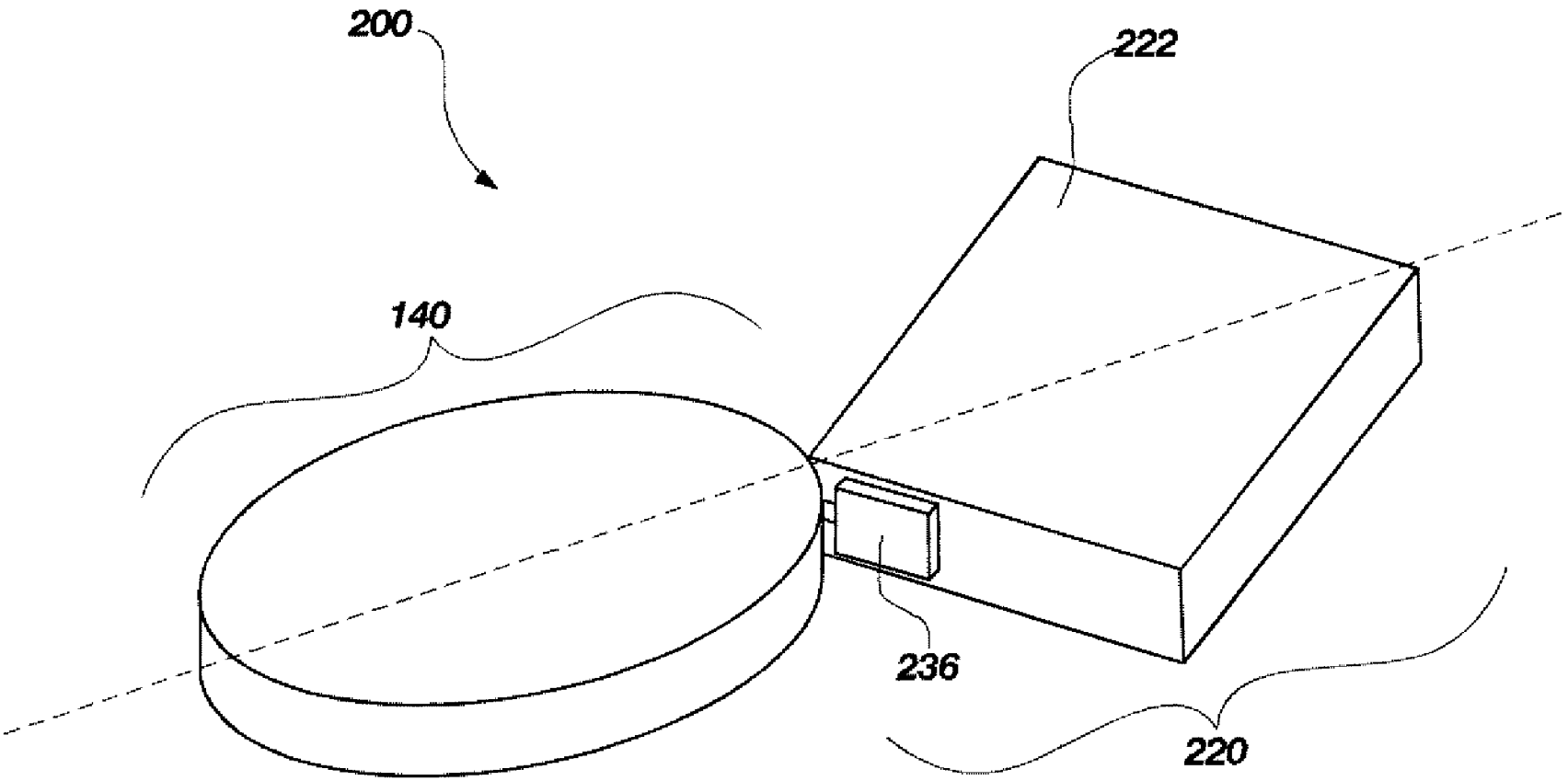
FIG. 3B is a perspective view of the exemplary embodiment of FIG. 3A in the assembled state.

The clasp 200 shown in FIG. 3A is shown in the assembled state in FIG. 3B wherein the first body 140 is connected to main body 222 of the female member 220 via male member 110 (not visible in FIG. 3B). In the assembled state, the displaceable aperture sealing member 236 may be disposed directly above and covering the second aperture 228 (not visible in FIG. 3B).

Alternatively, the main body 222 of the female member 220 may be formed having any shape. For example, the main body 222 may have a generally spherical shape, and aperture sealing member 236 may be displaceable circumferentially about the hollow main body 222.

One feature of the clasps previously described herein is that the main body of the female members may rotate relative to the interchangeable decorative jewelry pieces. For example, referring to FIGS. 1A and 1B, the first body 140 may rotate freely relative to the second body (female member) 120 which may often be a beneficial and desirable characteristic. It is further understood that rotation may be affected by altering the size of the first aperture relative to the elongated rod and enlarged member. Sometimes, however, it may be preferable to provide a clasp that precludes the rotation of one piece relative to the other. An embodiment of the invention that precludes such rotation is shown in FIG. 4.

Figure 4:
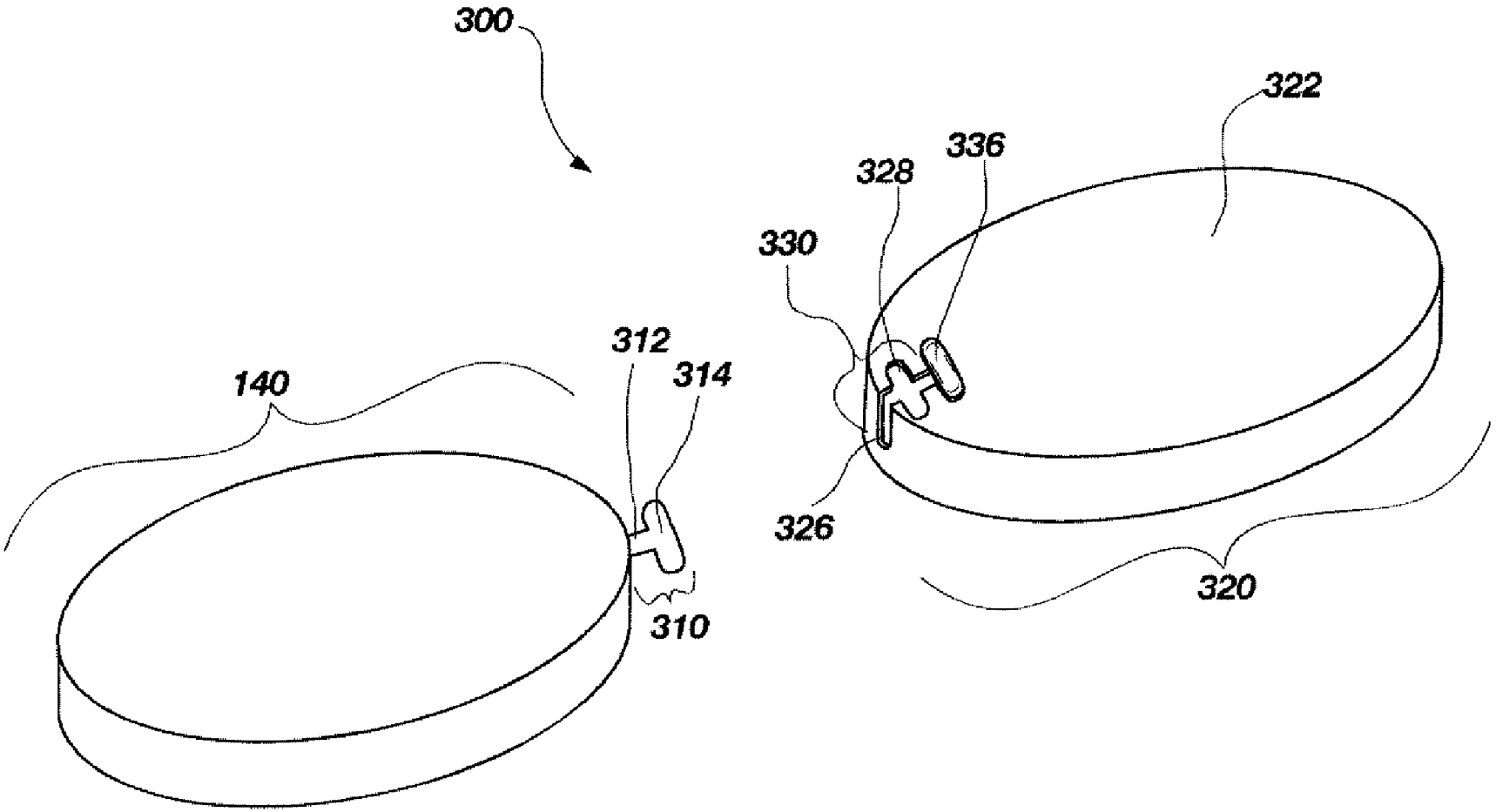
FIG. 4 is a perspective view of an exemplary embodiment of the invention.

An exemplary clasp 300 is shown in FIG. 4. The clasp 300 is substantially similar to the clasp 100 of FIG. 1A, and includes a T-shaped male member 310 having an elongated rod 312 and an enlarged member 314 provided on an end of the elongated rod 312. The enlarged member 314 may be formed as an elongated rod attached to, and oriented substantially perpendicular to, the elongated rod 312. The enlarged member 314 may have rounded or tapered surfaces and ends, as shown in FIG. 4. A female member 320 may be provided having an at least partially hollow main body 322, a first aperture 326, a second aperture 328, and a slot 330 extending continuously between the first aperture 326 and the second aperture 328. The T-shaped male member 310 helps prevent the first body 140 from rotating. The second aperture 328 may be formed as an elongated opening to allow both the enlarged member 314 and the elongated rod 312 of the male member 310 to pass therethrough. The first aperture 326 and the slot 330 are formed so as to allow passage of the elongated rod 312 therethrough, but to preclude passage of the enlarged member 314 therethrough. A displaceable aperture sealing member 336 may be movably attached to the main body 322 and disposed adjacent the exterior surface thereof. The male member 310 may be attached to a first body 140. The clasp 300 may be identical to the clasp 100 of FIG. 1A in all other respects and may operate in a similar fashion thereto as described previously herein.

Because the male member 310 precludes rotation of the first body 140 relative to the female member 320, each side of the first body 140 may include different designs, patterns, jewels, colors, etc., and the user may select which side of the first body 140 will be the front or visible surface.

Even though the clasp 300 is shown having a T-shaped male member 310, the clasp 300 alternatively may have a male member substantially similar to the male member 110 (shown in FIG. 1A). In addition, any of the other exemplary embodiments disclosed herein could be provided having a T-shaped male member 310.

Figure 5A:
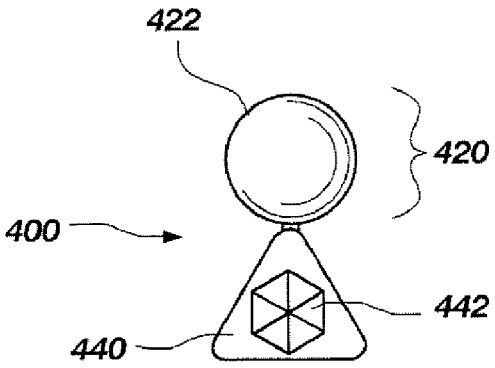
FIGS. 5A, 5B and 5C illustrate front and back elevational and exploded views, respectively, of earrings comprising an exemplary embodiment of the invention.
Figure 5B:
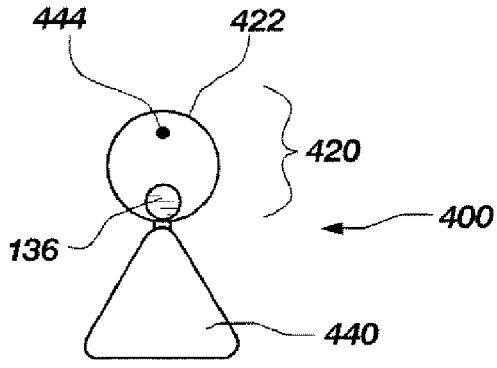

An earring clasp 400 according to the invention is shown in FIGS. 5A and 5B. The earring clasp 400 may be substantially similar to the clasp 100 of FIG. 1A, and may include a female member 420 and a male member (not visible in FIGS. 5A or 5B). The female member 420 may include an at least partially hollow main body 422, similar to the hollow main body 122 of FIG. 1A. The main body 422 of female member 420 may include an earring stud 444. The female member 420 may include a first aperture, a second aperture, a slot, and an aperture sealing member identical to those of the female member shown in FIG. 1A. An interchangeable decorative jewelry piece 440 may be attached to the male member and may have an optional jewel 442 disposed thereon. In this configuration, several different decorative jewelry pieces 440 may be interchanged with the earring stud of female member 420 as desired.

An elevational view of the back side of the earring clasp 400 is shown in FIG. 5B. The interchangeable decorative jewelry piece 440 is shown fastened and secured to the hollow main body 422 of the female member 420 by the male member (not visible). The displaceable aperture sealing member 136 is shown in the first position, directly above the second aperture (not visible).

Figure 5C:
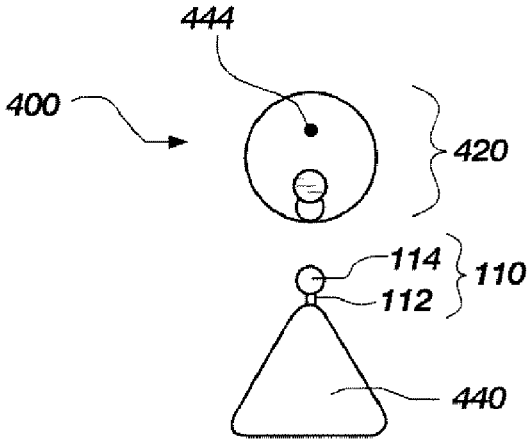

The earring clasp 400 may be provided with various multiple interchangeable decorative jewelry pieces 440, each having different jewels, gem stones, patterns, colors, or other features that are interchangeable with the female member 420 of the earring clasp 400. This allows the user to change and customize the earring to match clothing, create new and unique pieces of jewelry, etc. Further, by designing the earring clasp 400 such that the male member is attached to the decorative jewelry pieces 440, the user can grasp the larger decorative jewelry piece 440, rather than the smaller male member, which increases the ease with which the decorative jewelry piece 440 may be connected to the earring stud. It will be understood that the shape of female member 420 and the decorative jewelry pieces 440 are not limited. FIG. 5C depicts an elevational view of the back side of the earring clasp 400. The female member 420 having an earring stud 444 is shown separated from the decorative jewelry piece 440. The decorative jewelry piece 440 attaches to the female member 420 via an elongated rod 112 and enlarged member 114 of a male member 110.

Figure 6A:
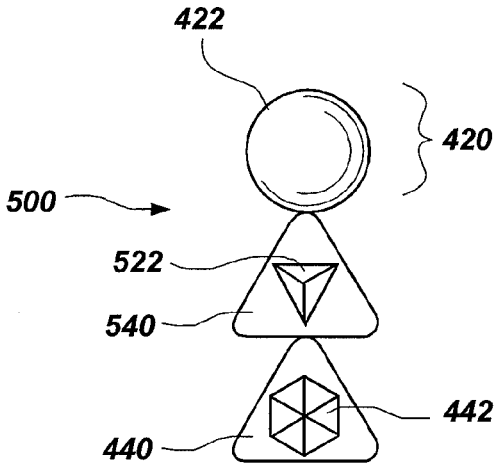
FIGS. 6A, 6B and 6C illustrate front and back elevational views and an exploded view respectively of earrings comprising an exemplary embodiment of the invention.
Figure 6B:
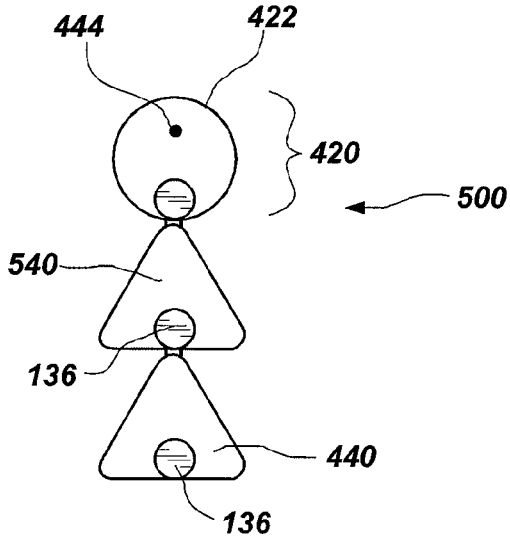
Figure 6C:
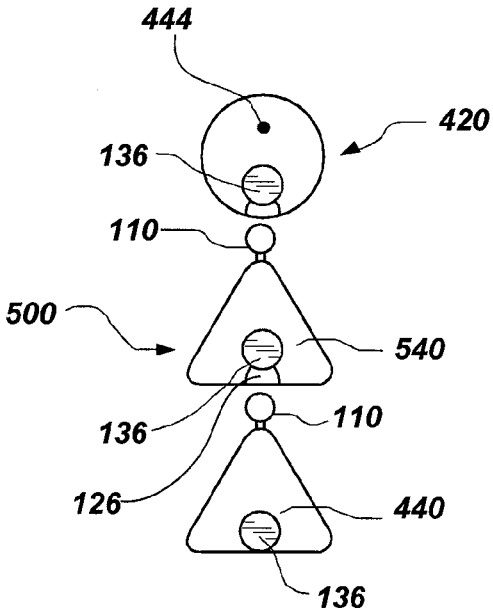

An exemplary earring clasp 500 according to the invention is shown in FIGS. 6A, 6B and 6C. The earring clasp 500 may be substantially similar to the earring clasp 400 of FIGS. 5A, 5B and 5C. The earring in FIGS. 6A, 6B and 6C further includes a linker piece 540 disposed between the female member 420 and the decorative jewelry piece 440. The linker piece 540 may include a male member 110 that attaches the linker piece 540 to the female member 420 as well as a first aperture 126 that connects the linker piece 540 to the decorative jewelry piece 440 (FIG. 6C). The male member 110 of the decorative jewelry piece 440 may be attached to the linker piece 540 as described in other embodiments. The earring of FIGS. 6A, 6B and 6C may include a plurality of linker pieces 540 disposed between the female member 420 and the decorative jewelry piece 440. Further, the decorative jewelry piece 440 could also be a linker piece 540 with both male and female connecting parts. Linker piece 540 may have an optional jewel 522 disposed thereon. It will be understood that while the decorative member having both male and female parts is shown as part of an earring in FIGS. 6A, 6B, and 6C, the decorative member having both male and female parts may be incorporated into any piece including a bracelet, pendant, necklace, brooch, etc.

Figure 7A:
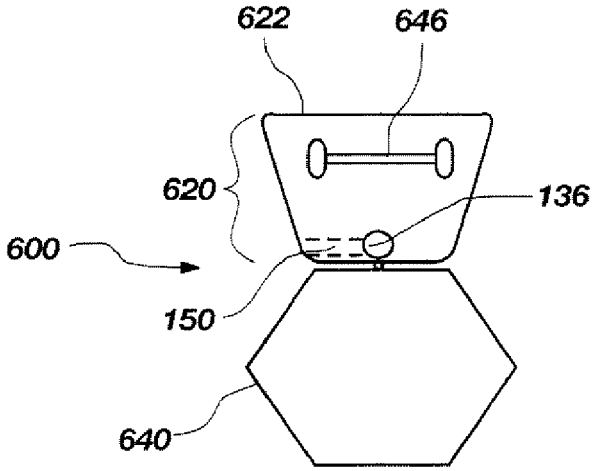
FIG. 7A is a front elevational view of a pendant comprising an exemplary embodiment of the invention.
Figure 7B:
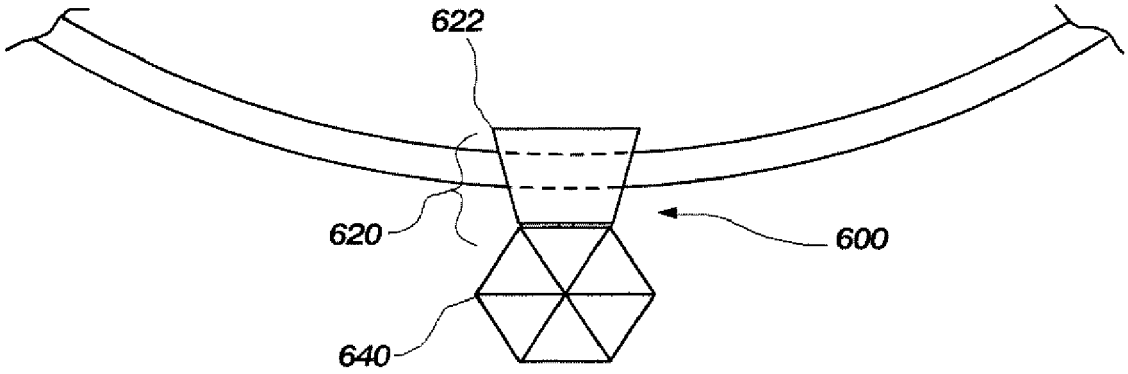
FIG. 7B is a back elevational view of the pendant of FIG. 7A hanging from a necklace.

A pendant clasp 600 according to the invention is shown in FIGS. 7A and 7B. The pendant clasp 600 may be substantially similar to the clasp 100 of FIG. 1A, and may include a female member 620 and a male member (not visible in FIGS. 7A and 7B). The female member 620 may include an at least partially hollow main body 622, similar to the main body 122 of FIG. 1A. The main body 622 of the female member 620 may include a decorative jewelry piece of the pendant. The female member 620 may include a first aperture (not visible), a second aperture (not visible in FIG. 7A or 7B), a slot (not visible in FIG. 7A or 7B), and an aperture sealing member 136 substantially identical to those of the second body 120 of FIG. 1A. An optional pin 646 for attaching the pendant to an article of clothing may be provided on the back side of the hollow main body 622. An interchangeable decorative jewelry piece 640 is shown that is attached to a male member (not visible in FIG. 7A or 7B), by which the jewelry piece 640 may be fastened and secured to the main body 622 of the female member 620. The displaceable aperture sealing member 136 is shown in the first position, directly above and covering the second aperture (not visible in FIG. 7A or 7B). The decorative jewelry pieces 640 may include both male and female parts and function as the linker piece 540 described in relation to FIGS. 6A, 6B and 6C. The main body 622 of the female member 620 also may include additional apertures on the sides of the female member 620, to allow a chain, necklace or bracelet to pass therethrough as shown in FIG. 7B. In this configuration, the pendant clasp 600 may be attached to clothing or worn on a necklace or bracelet.

The pendant clasp 600 may include a tubular member (as described with reference to FIGS. 2A and 2B) disposed within the main body 622 of the female member 620. As illustrated in FIG. 7A, the tubular member 150 (shown by the dotted lines) extends laterally within the female member 620, and the displaceable aperture sealing member 136 is displaceable in the leftward direction in FIG. 7A. The tubular member 150 would be located so as not to interfere with passage of a chain or other material through any additional apertures in the side of female member 620.

By use of the pendant clasp 600 with interchangeable decorative jewelry pieces 640 attached to a male member, multiple interchangeable decorative jewelry pieces 640 may be provided, each having different jewels, patterns, colors, or other features that are interchangeable with the female member 620 of the pendant clasp 600. This allows the user to change and customize the pendant to match clothing, create new and unique pieces of jewelry, etc.

The use of clasps according to the invention allows for interchangeable decorative pieces to be used on various pieces of jewelry such as earrings, bracelets, necklaces, pendants, etc. For example, the interchangeable decorative jewelry pieces 640 may be used with the earring clasp 400 of FIGS. 5A and 5B, while the interchangeable decorative jewelry pieces 440 may be used with the pendant clasp 600 of FIGS. 7A and 7B.

When interchangeable decorative jewelry pieces are used in jewelry that includes a clasp according to the invention, the interchangeable pieces may include the male member, the female member or both. For example, an earring stud may be attached to the male member, and the main body of the female member may include an interchangeable decorative jewelry piece that attaches to the male member of the earring stud. The same principle applies to pendants and other pieces of jewelry as well. In addition, individual pieces of jewelry could be provided having either two female members, one at each end, or two male members, one at each end.

Figure 8A:
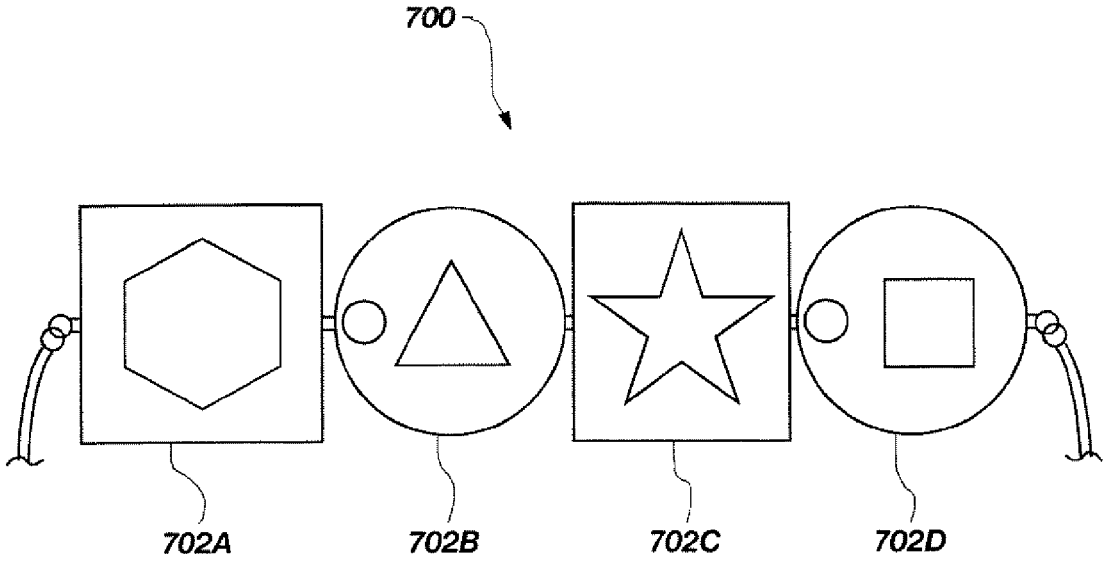
FIG. 8A is a plan view illustrating multiple, linked jewelry pieces, each comprising an exemplary embodiment of the invention.
Figure 8B:
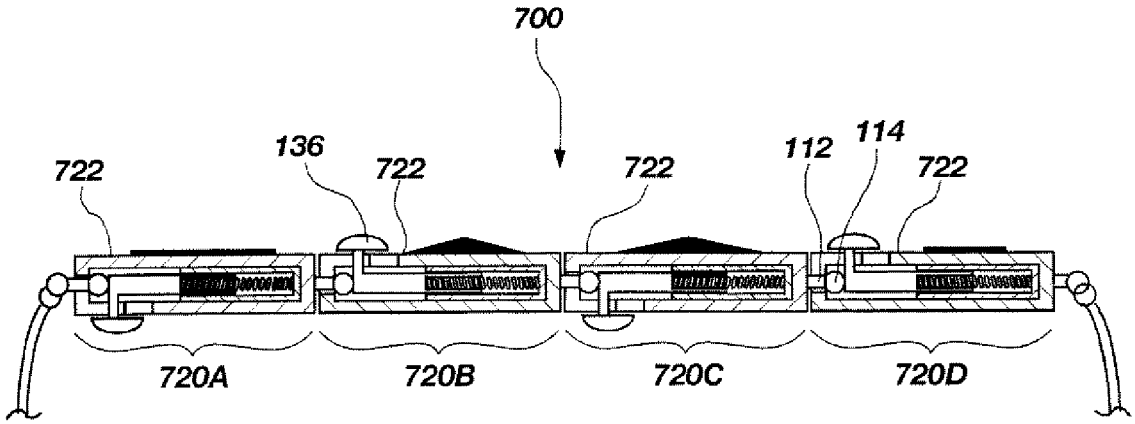
FIG. 8B is a sectional view of the embodiment of FIG. 8A.

FIGS. 8A and 8B illustrate an exemplary piece of jewelry 700 that includes several interconnected, interchangeable decorative jewelry pieces 702A, 702B, 702C, and 702D. The piece of jewelry 700 may be part of a bracelet or necklace. Each interchangeable decorative jewelry piece may include a female member, such as female members 720A, 720B, 720C, and 720D, and a male member. Each female member may include a main body 722, similar to the main body 122 of FIG. 1A. Each of the female members 720A, 720B, 720C, and 720D may include a first aperture, a second aperture, a slot, and an aperture sealing member 136 substantially identical to those of the second body (female member) 120 (as described with reference to FIG. 1A).

In addition, a male member, including an elongated rod 112 and an enlarged member 114, may be attached to and extend from a surface of each of the main bodies 722 of female members 720A, 720B, 720C, and 720D. In this configuration, each of the interchangeable decorative jewelry pieces 702A, 702B, 702C, and 702D may be attached together, and may include individual links of a chain, such as a bracelet or necklace. As illustrated, each piece may be shaped differently, colored differently, have different patterns formed on the exterior surface, etc., thereby providing variability and allowing the user to design unique jewelry pieces. Also, a user may remove any of the links without disassembling the entire piece of jewelry as is required with conventional bracelets or necklaces. Referring to FIG. 8B, the displaceable aperture sealing member 136 may be located adjacent the top surface of the hollow main bodies 722, as in interchangeable decorative jewelry pieces 702B and 702D. Alternatively, the displaceable aperture sealing member 136 may be located adjacent the bottom surface of the hollow main bodies 722, as in interchangeable decorative jewelry pieces 702A and 702C. In addition, while the displaceable aperture sealing member 136 is shown as a partial dome, it could be configured in other decorative shapes such as, for example, a flat colored disc having a pattern thereon, and may include jewels, stones, etc.

As seen in FIGS. 8A and 8B, one end of each of the decorative jewelry pieces 702A and 702D (the end pieces), may be attached by known methods to the ends of a bracelet or a necklace. Alternatively, several more decorative jewelry pieces may be provided to provide a complete bracelet or necklace consisting only of individual decorative jewelry pieces and no chain. Further, while the of the decorative jewelry pieces 702B and 702D are shown with the displaceable aperture sealing member 136 on the top of the jewelry piece, it is understood that the decorative jewelry pieces 702B and 702D may be positioned such that the displaceable aperture sealing member 136 is not visible when the jewelry is worn.

Figure 9:
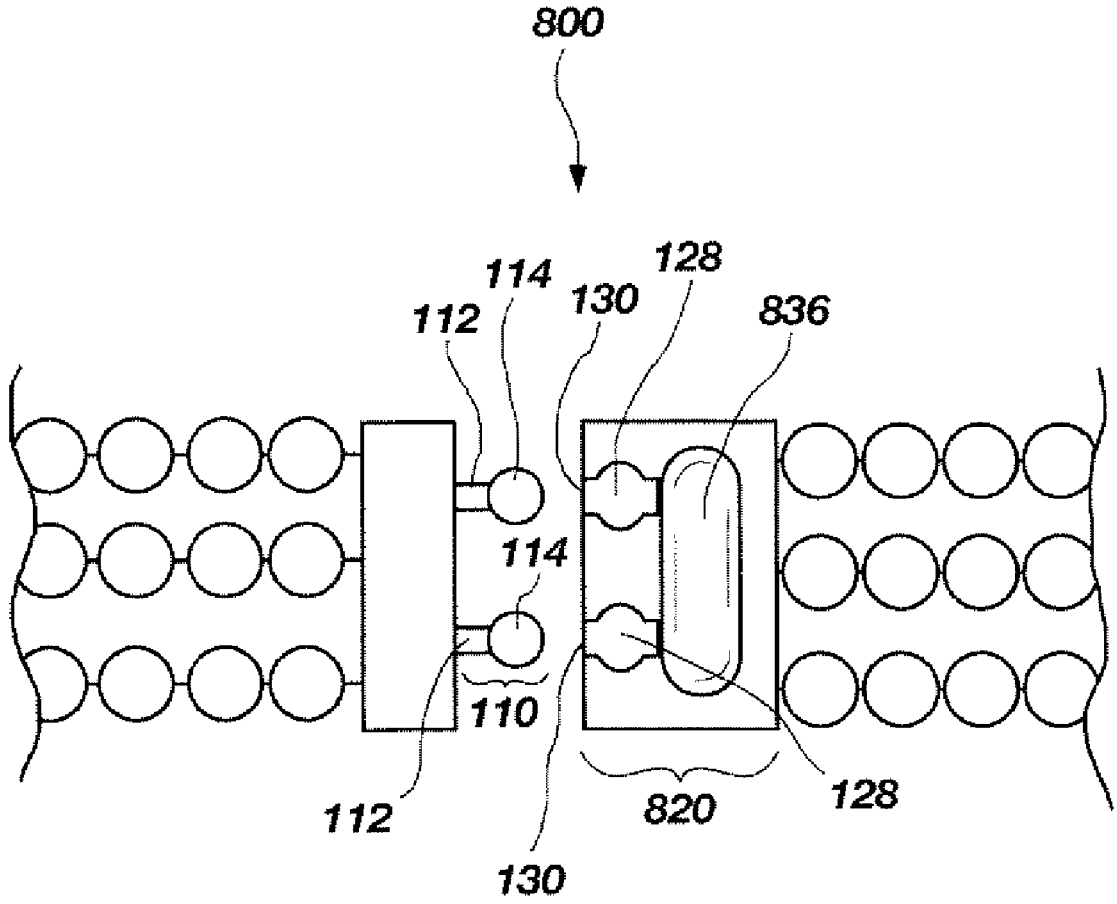
FIG. 9 is a front elevational view of a clasp for a bracelet comprising an exemplary embodiment of the invention.

A jewelry piece is illustrated in FIG. 9 that includes three strands of pearls, the ends of which are connected with a jewelry clasp 800 according to the invention. The jewelry clasp 800 is similar to the clasp 100 of FIG. 1A, except that jewelry clasp 800 includes two male members 110, each including an elongated rod 112 and an enlarged member 114. The female member 820 of the jewelry clasp 800 includes two first apertures (not visible in FIG. 9), two second apertures 128, and two slots 130. In addition, jewelry clasp 800 includes a displaceable aperture sealing member 836 that is larger than the displaceable aperture sealing member 136 of the clasp 100 (as disclosed with reference to FIG. 1A) to allow coverage of both of the second apertures 128.

To fasten the male members 110 with the female member 820, a force is exerted on the aperture sealing member 836, causing a spring (not shown in FIG. 9), to compress and the aperture sealing member 836 to move out of the first position (not shown in FIG. 9) and into the second position as shown in FIG. 9, thereby exposing the second apertures 128. The enlarged members 114 of the male members 110 then may be inserted through the second apertures 128 until the enlarged members 114 are disposed in a void (not shown in FIG. 9) of the female member 820 and the elongated rods 112 are extending through the second apertures 128.

The male members 110 may be displaced relative to the second body 120 such that the elongated rods 112 pass along or slide through the length of the slots 130 of the female member 820 until the elongated rods 112 are extending through the first apertures, the enlarged members 114 continuing to be disposed within the void of the female member 820 and retained by the interior surface (not visible in FIG. 9) thereof.

The displaceable aperture sealing member 836 then may be released, allowing the biasing member or spring (not visible in FIG. 9) to extend, causing the aperture sealing member 836 to return to the first position covering the second apertures 128. In this configuration, the enlarged members 114 may be precluded from passing through the second apertures 128 and thereby retained and secured within the void of the female member 820. The use of two male members 110 and two corresponding sets of apertures preclude rotation of one end of the bracelet relative to the other end.

Figure 10:
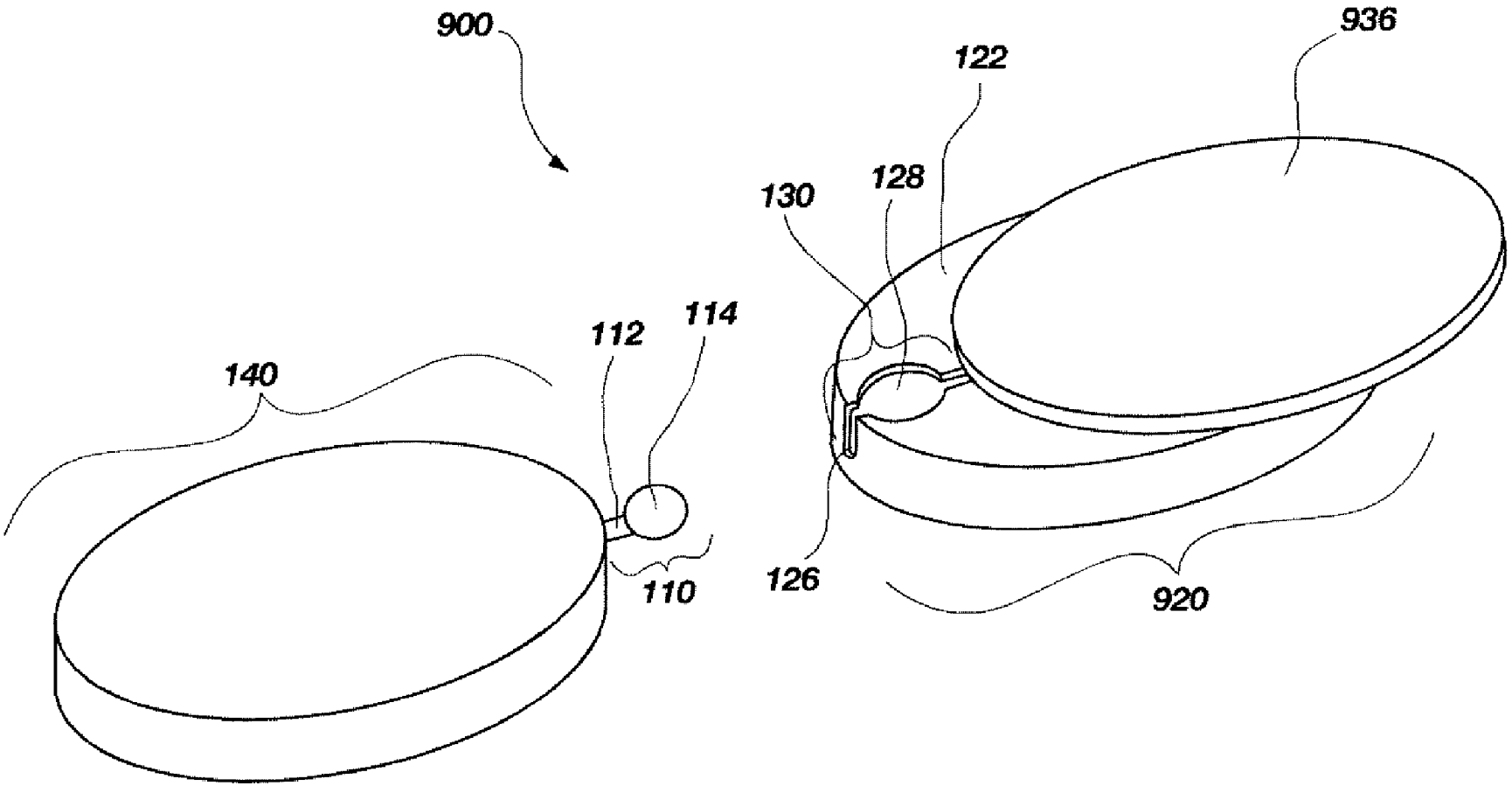
FIG. 10 is a perspective view of an exemplary embodiment of the invention.
Figure 11:
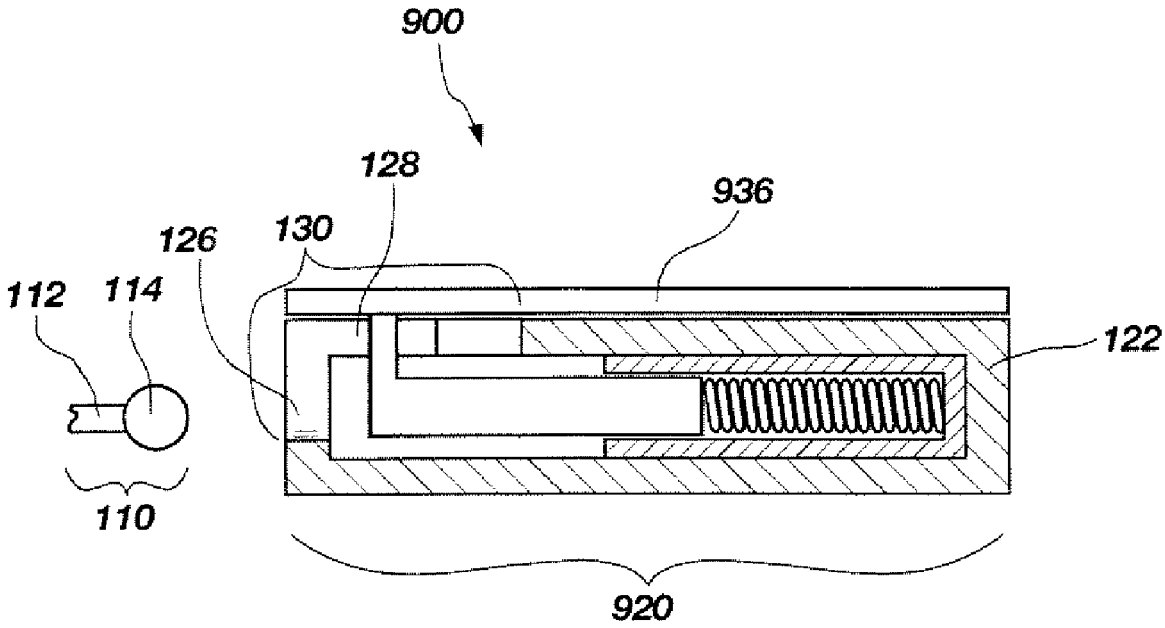
FIG. 11 is a sectional view of the embodiment of FIG. 10.

An exemplary clasp 900 is shown in FIG. 10. The clasp 900 is substantially similar to the clasp 100 of FIG. 1A, and includes a male member 110 having an elongated rod 112 and an enlarged member 114 provided on an end of the elongated rod 112. A female member 920 may be provided having an at least partially hollow main body 122, a first aperture 126, a second aperture 128, and a slot 130 extending continuously between the first aperture 126 and the second aperture 128. The second body (female member) 120 also includes a displaceable aperture sealing member 936 having a shape substantially similar to the shape of the hollow main body 122 as shown in FIG. 10. The male member 110 may be attached to a first body 140. The clasp 900 may be identical to the clasp 100 of FIG. 1A in all other respects and may operate in a similar fashion thereto as described previously herein. In this configuration, the entire top surface of the female member 920, which includes the displaceable aperture sealing member 936, is displaceable between a first position directly above and covering the second aperture 128 as shown in FIG. 11, and a second position laterally adjacent the second aperture 128 as shown in FIG. 10, in which the second aperture 128 is exposed. This configuration provides a larger surface against which a user may exert a force to open the clasp which makes the clasp easier to open and close.

The displaceable aperture sealing member 936 is shown in FIGS. 10 and 11 having a flat upper surface. Alternatively, the displaceable aperture sealing member 936 may have a dome shaped upper surface, a textured upper surface for enhanced grip, and may include patterns, jewels, or other decorations on the upper surface. In addition, the female member 920 may have a dome shaped bottom surface, a textured bottom surface to enhance grip, and may include patterns, jewels, or other decorations on the bottom surface. In this configuration, a user may choose whether to wear the jewelry displaying either the upper surface or the bottom surface.

Figure 12:
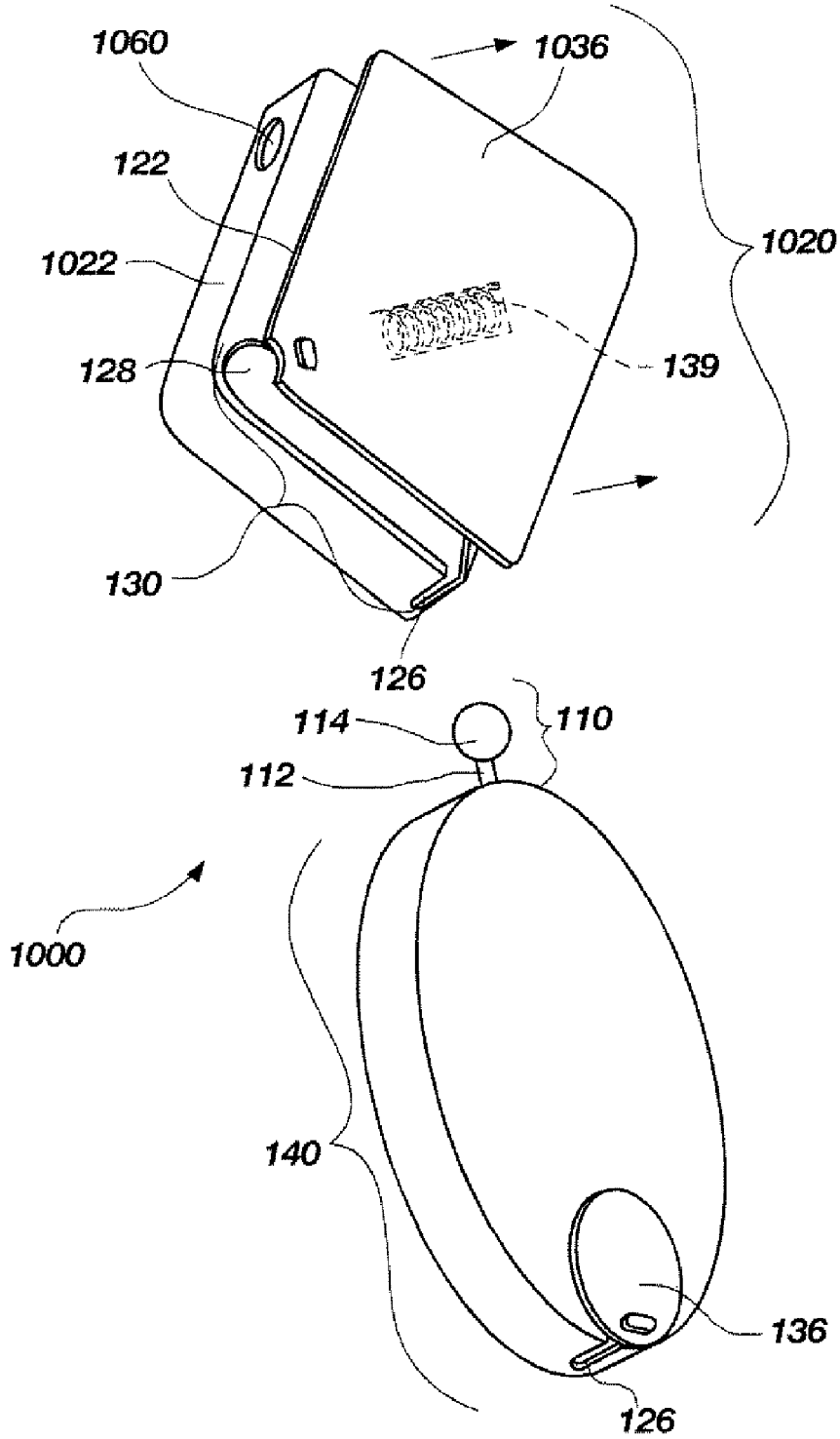
FIG. 12 is a perspective view of an exemplary embodiment of the invention.

An exemplary clasp 1000 is shown in FIG. 12. The clasp 1000 is substantially similar to the clasp 100 of FIG. 1A, and includes a first body 140 having a male member 110 having an elongated rod 112 and an enlarged member 114 provided on an end of the elongated rod 112. The first body 140 may also include female connecting parts such as a displaceable aperture sealing member 136, a first aperture 126, a second aperture (not visible in FIG. 12), and a slot (not visible in FIG. 12) extending continuously between the first aperture 126 and the second aperture.

A female member 1020 may be provided having an at least partially hollow main body 122, a first aperture 126, a second aperture 128, and a slot 130 extending continuously between the first aperture 126 and the second aperture 128. The female member 1020 also includes a displaceable aperture sealing member 1036 having a shape substantially similar to the shape of the main body 122. The displaceable aperture sealing member 1036 may include a textured surface 1022 to assist in moving the displaceable aperture sealing member 1036. If desired, the female member 1020 shown in FIG. 12 may also include a male member located anywhere on the main body 122 that would allow attachment to another jewelry piece. The main body may also include additional openings 1060 to accommodate a string or chain so that the female member 1020 functions as a pendant. In FIG. 12, the first aperture 126, second aperture 128, and slot 130 are shown proximate a side of the main body 122. The clasp 1000 may be identical to the clasp 100 of FIG. 1A in all other respects and may operate in a similar fashion thereto as described previously herein.

The female member 1020 may include a tubular member (as described with reference to FIGS. 2A and 2B) disposed within the main body 122 of the female member 1020. The tubular member may include a spring 139 that extends laterally within the female member 1020 parallel to the direction the displaceable aperture sealing member 1036 moves. The tubular member would be located so as not to interfere with passage of a chain or other material through any additional apertures in the side of female member 1020. The spring 139 may function in a number of ways such as the systems described herein.

The clasps disclosed herein may be incorporated into individual jewelry pieces to allow the sale of individual, interchangeable decorative jewelry pieces of different color or design. The clasps disclosed herein provide a secure connection between members, which prevents unintentional unfastening of the clasp. The clasps of the present invention may also be used as a conventional jewelry clasp for securing the ends of a jewelry piece together. The clasps provide both a releasable and a secure attachment between members.

Many varying and differing embodiments of the invention may be made exhibiting the important features and characteristics disclosed herein. It should be understood that the description of the invention provided herein must be interpreted as illustrative of the novel features and characteristics of the invention and not as defining the limitations or as providing examples of the only embodiments that are within the scope of the invention.

What is claimed is:

1. A connecting device for a jewelry piece, comprising:

a male member and a female member, at least one of the male member and the female member comprising a jewelry component;

wherein the male member comprises a first section and a larger second section; and wherein the female member comprises:

a main body having at least one hollow portion, an outer wall, and an exterior surface;

at least one aperture formed through a portion of the outer wall, the at least one aperture comprising:

a first portion sized to preclude passage of the larger second section and to allow passage of the first section of the male member therethrough; and a second larger portion continuous with the first portion and sized to allow passage of the first section and the larger second section of the male member therethrough;

a biasing element receiving member disposed within the main body of the female member;

a displaceable aperture sealing member having a first portion disposed adjacent the exterior surface of the main body and a second portion disposed within the main body of the female member, the displaceable aperture sealing member being movable between a first position in which the first portion of the displaceable aperture sealing member at least partially covers the second larger portion of the at least one aperture, and a second position in which the second larger portion of the at least one aperture is exposed; and a biasing member bearing against each of the second portion of the displaceable aperture sealing member and the biasing element receiving member and biasing the displaceable aperture sealing member toward the first position.

2. The connecting device of claim 1, wherein the first section of the male member has a first diameter and the second section of the male member has a second diameter, the second diameter being larger than the first diameter.

3. The connecting device of claim 2, wherein the first portion of the at least one aperture comprises a third diameter, the third diameter being greater than the first diameter of the first section of the male member and less than the second diameter of the second section of the male member.

4. The connecting device of claim 3, wherein the second larger portion of the at least one aperture comprises a fourth diameter, the fourth diameter being greater than the second diameter of the second section of the male member.

5. The connecting device of claim 4, wherein the at least one aperture further comprises a slot formed through the outer wall of the main body extending between the first portion of the at least one aperture and the second larger portion of the at least one aperture, the slot having a width less than the second diameter of the second section of the male member.

6. The connecting device of claim 5, wherein the slot has a width less than the third diameter of the first portion of the at least one aperture.

7. The connecting device of claim 1, further comprising an interchangeable jewelry piece attached to the male member.

8. The connecting device of claim 1, wherein the at least one aperture comprises two apertures.

9. An article of manufacture comprising a plurality of reversibly connected components, each component comprising:

a main body having at least one hollow portion, an outer wall, and an exterior surface, at least one aperture formed through the outer wall, the at least one aperture comprising a first portion; and a second larger portion continuous with the first portion;

a displaceable aperture sealing member adjacent the exterior surface of the main body, the displaceable aperture sealing member being movable between a first position, at least partially covering the second larger portion of the at least one aperture, and a second position exposing the second larger portion of the at least one aperture;

a rod extending from the exterior surface of the main body, the rod being disposed on a side of the main body generally opposite the first portion of the at least one aperture; and an enlarged member formed on an end of the rod distant to the main body.

10. The article of claim 9, wherein each component of the plurality of components is interconnected, the enlarged member of a first component being disposed inside the main body of a second component of the plurality of components, the rod of the first component extending through the first portion of the at least one aperture of the second component.

11. The article of claim 9, wherein the main body of each component comprises an individual jewelry piece.

12. The article of claim 9, wherein the displaceable aperture sealing member is displaceable in a direction generally parallel to a line extending through the first portion of the at least one aperture and the second larger portion of the at least one aperture.

13. The article of claim 9, wherein the displaceable aperture sealing member is displaceable in a direction generally perpendicular to a line extending through the first portion of the at least one aperture and the second larger portion of the at least one aperture.

14. The article of claim 9, wherein the main body is substantially disc-shaped.

15. The article of claim 14, wherein the first portion of the at least one aperture is disposed on an edge of the main body, the second larger portion of the at least one aperture being disposed on a surface of the main body adjacent the edge and proximate the first portion of the at least one aperture.

16. The article of claim 9, wherein the main body is formed substantially in the shape of a sphere.

17. The article of claim 9, wherein the displaceable aperture sealing member is displaceable circumferentially about the exterior surface of the main body.

18. A method of removably securing together two members of an article of jewelry, the method comprising:

providing a first member comprising:

a rod extending from a main body of the first member; and a retaining member formed on an end of the rod opposite the main body of the first member;

providing a second member comprising:

a main body having at least one hollow portion, an outer wall, and an exterior surface;

at least one aperture formed through the outer wall, the at least one aperture comprising:

a first portion sized to preclude passage of the retaining member but to allow passage of the rod of the first member therethrough; and a second larger portion continuous with the first portion and sized to allow passage of the retaining member and the rod therethrough;

a biasing element receiving member disposed within the main body of the second member;

a displaceable aperture sealing member having a first portion adjacent the exterior surface of the main body of the second member and a second portion within the main body of the second member, the displaceable aperture sealing member being movable between a first position in which the first portion of the displaceable aperture sealing member at least partially covers the second larger portion of the at least one aperture, and a second position in which the second larger portion of the at least one aperture is exposed; and a biasing member applying a force on each of the second portion of the displaceable aperture sealing member and the biasing element receiving member and biasing the displaceable aperture sealing member toward the first position;

wherein at least one of the first member and the second member comprises a jewelry component;

positioning the displaceable aperture sealing member in the second position;

inserting the retaining member of the first member through the second larger portion of the at least one aperture;

moving the first member relative to the second member until the rod of the first member extends through the first portion of the at least one aperture and the retaining member is disposed inside the main body of the second member; and positioning the displaceable aperture sealing member in the first position, thereby precluding the retaining member from passing through the second larger portion of the at least one aperture to the exterior of the main body of the second member.

19. A connecting device for a piece of jewelry, comprising:

a male member comprising a first section and a larger second section; and a female member comprising:

a main body having at least one hollow portion, an outer wall, and an exterior surface, wherein the main body comprises a component of a jewelry piece selected from the group consisting of a bracelet, a necklace, an earring, and a pendant;

at least one aperture formed through a portion of the outer wall, the at least one aperture comprising:

a first portion sized to preclude passage of the larger second section and to allow passage of the first section of the male member therethrough; and a second larger portion continuous with the first portion and sized to allow passage of the first section and the larger second section of the male member therethrough; and a tubular member disposed within the main body of the female member;

a displaceable aperture sealing member having a first portion adjacent the exterior surface of the main body and a second portion disposed within the main body of the female member, the second portion of the displaceable aperture sealing member cooperating with and moveable relative to the tubular member, the displaceable aperture sealing member being movable between a first position in which the first portion of the displaceable aperture sealing member at least partially covers the second larger portion of the at least one aperture, and a second position in which the second larger portion of the at least one aperture is exposed; and a spring at least partially disposed within the tubular member, the spring bearing against the second portion of the displaceable aperture sealing member and biasing the displaceable aperture sealing member toward the first position.

20. The connecting device of claim 19, wherein the female member further comprises an elongated rod extending from the main body, the elongated rod having an enlarged member configured to reversibly connect to a separate additional female member.

* * * * *